US006796684B1

(12) United States Patent
Beadle

(10) Patent No.: US 6,796,684 B1
(45) Date of Patent: Sep. 28, 2004

(54) ADJUSTABLE RECESSED LIGHT FIXTURE

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 114 days.

(21) Appl. No.: 09/948,435

(22) Filed: Sep. 7, 2001

(51) Int. Cl.[7] ..... F21V 19/02; F21V 21/26

(52) U.S. Cl. ..... 362/287; 362/418; 362/374; 362/375; 362/372

(58) Field of Search ..... 362/287, 285, 362/418, 427, 374, 375, 372, 362, 364, 365

(56) References Cited

U.S. PATENT DOCUMENTS 2,886,630 A 5/1959 Gill
4,599,485 A 7/1986 Smolik
4,634,015 A 1/1987 Taylor
4,941,071 A * 7/1990 Knauf ..... 362/133
5,222,303 A 6/1993 Jardine
5,564,815 A * 10/1996 Littman et al. ..... 362/147
5,967,354 A 10/1999 Whitehead et al.
6,502,967 B2 * 1/2003 Mullen ..... 362/427
6,517,216 B1 * 2/2003 Cercone et al. ..... 362/220

* cited by examiner

*Primary Examiner*—Thomas M. Sember
(74) *Attorney, Agent, or Firm*—Eleanor M. Musick; Procopio Cory Hargreaves & Savitch

(57) ABSTRACT

The recessed light fixture has an adjustable structure enabling it to be rotated in relation to the ground located beneath it or other reference level so that it is level, while it remains attached to a support structure. The recessed light fixture includes a cover and a light assembly contained within a housing. The light assembly is attached to the housing using retention members that are positioned within elongated receiving slots located on the light assembly. The receiving slots allow the light assembly to be rotated within the housing. Further, the receiving slots enable the light assembly and cover attached to the light assembly to be repositioned without having to reinstall the housing.

34 Claims, 3 Drawing Sheets

ADJUSTABLE RECESSED LIGHT FIXTURE

FIELD OF THE INVENTION

The invention is directed generally to an adjustable electrical light fixture, and more particularly, to a recessed light fixture capable of rotational adjustment so that the light fixture may appear to be level in relation to the ground beneath it.

BACKGROUND

Recessed light fixtures are becoming increasingly popular because of their numerous inherent advantages in both indoor and outdoor lighting installations. A significant advantage of recessed light fixtures is their ability to provide light in locations where light fixtures have traditionally not been located because they might create an obstacle in a traffic area or because they might detract from the desired visual impact of the area. Typically, recessed lighting may be located in areas such as walls, ceilings, hallways, walkways, retaining walls and nearly any other location desired.

In new commercial buildings such as office buildings, hotels and shopping malls, environmental lighting is often specified by the architect as part of the design. When recessed light fixtures are included in the lighting plans, it is desirable to prepare the site for the installation during construction by forming recesses or receptacles into which the fixture can be placed so that it is substantially flush with, or only slightly extending out from, the wall surface. The advance preparation of the installation site avoids the necessity of cutting holes in the wall after construction is completed, which can be particularly problematic for concrete, brick or stone walls. Even so, it remains difficult to install a recessed light assembly during construction of a supporting structure so that the light assembly is level with the ground beneath it upon completion.

For instance, during construction of a wall composed of concrete, recesses are formed by building into the mold a structure corresponding to each recess which is linked to one or more electrical conduits through which the wiring will be run. The housing may be attached to the mold so that the concrete forms around it. When the wet cement is poured into the mold, the mold or housing defines the location, shape and orientation of the recess. However, under the weight of the cement, some shifting may occur. Furthermore, while a mold builder typically attempts to correctly position the structure for the housing, rarely is a level used to ensure proper orientation. If the mold builder is under an impending time deadline, the leveling of the housing for the recessed light fixture is generally not very high on the list of priorities, exacerbating the leveling problem. As a result, it is not uncommon for the housings for recessed light fixtures to be tilted at an orientation which is not parallel to the ground. The lack of leveling becomes particularly noticeable when there are a number of recessed light fixtures installed in a wall along a walkway, where it becomes very obvious that the fixtures do not follow a straight line. Thus, one generally should not rely solely on the concrete formers to ensure correct installation of the light fixture.

For installation in stucco walls or drywall, a housing or box for supporting the recessed light fixture is typically mounted within a wooden frame built within the structure supporting the wall. Generally, the fixture housing is roughed into the wall using flex conduit. It may be nailed or screwed to the frame. While mounting the housing for a recessed light fixture within a stucco wall or drywall may be easier than mounting it within a concrete, brick or stone wall, it is not uncommon that after its installation, but before completion of the wall, the housing mounted in the wall will be struck or bumped in a way that will knock the housing out of position. Thus, even though the housing was positioned correctly within the structure at the outset, the light fixture is not in the correct position upon completion of the wall.

Thus, the need remains for a recessed light fixture having an means of adjustment enabling the light assembly to be positioned and moved independent of its housing so that the light fixture appears to be level in relation to the floor or other desired point of reference.

SUMMARY OF THE INVENTION

In an exemplary embodiment, the recessed light fixture comprises an adjustable structure which allows the light fixture to be rotated so that it is level in relation to the ground located beneath it. The light fixture includes a housing, a light assembly and a retention member. The light assembly is disposed within the housing and retained using the retention members that are attached to the housing. The light assembly Is composed of at least one light bulb receptacle and at least one slot for receiving the at least one retention member. The housing includes an opening for receiving the light assembly and a flange positioned within the opening.

The light assembly further comprises a frame and at least one light bulb receptacle. The frame comprises two support members and, in a preferred embodiment, a plurality of reflective surfaces. The plurality of reflective surfaces are attached to and positioned between the two support members. The two support members further comprise at least one mounting plate, at least one transition plate, and at least one receptacle receiving plate. In one embodiment, the at least one mounting plate includes a slot for receiving the retention member. The slot may be positioned in numerous locations on the at least one mounting plate including an upper edge, a bottom edge, or a side edge. Essentially, the slot is positioned so that the light assembly may be rotated within the housing so that it appears to be level with the ground beneath it. During rotation, each retention member located within a slot guides the light assembly. The at least one light bulb receptacle can be any standard light bulb receptacle or may be a custom design. Further, the at least one light bulb receptacle is mounted to the at least one receptacle receiving plate.

In one embodiment, the plurality of reflective surfaces are mounted to two receptacle receiving plates proximate to at least one light bulb attached to the at least one light bulb receptacle in order to reflect light produced by the at least one light bulb out the opening of the housing. The reflective surfaces have numerous finishes ranging from complete reflection to partial reflection.

The recessed light fixture is mounted to a wall or other generally vertical structure by first positioning the housing within the wall. Preferably, this is accomplished during the construction phase because it is less time consuming than forming the necessary recess or hole after completion of the wall. During the process of mounting the housing to a wall, electrical wires are inserted through knock-out ports located within the housing. After the housing has been mounted to the wall, the electrical wires are connected to the at least one light receptacle. The light assembly is then mounted to the housing. If the retention members are already mounted in the flanges of the housing, the light assembly is Inserted into the housing and rotated slightly to secure the retention members within the slots. Otherwise, the light assembly is inserted into the housing and the retention members are inserted through the slots and the holes in the flanges. Once the light assembly is secure, the cover is installed on the light assembly using various attachment means, including, but not limited to, screws, releasable adhesives, bayonet mounts, retention snaps or other retaining methods.

The installer then assesses the position of the cover. If the cover is correctly positioned, the installation process is complete. However, if the cover is not in correct alignment with the desired reference surface, the light assembly can be adjusted. First, the installer determines the approximate angle of deviation from level. In one embodiment, the light assembly can be adjusted by removing the cover and backing out the at least one retention member. The light assembly can then be repositioned and the retention members placed in tension once again. The cover is re-installed and its position is checked once again. Once the cover is in the proper position, the installation process is complete. Otherwise, this process is repeated until the installer is satisfied with the light assembly's position.

In another embodiment, the light assembly's position may be changed without removing the cover. Specifically, the cover may contain openings and vents, which operate to deflect light downward. Further, a portion of the at least one opening may be sized to allow the retention members to be accessed from outside the cover. Thus, the installer may back off the retention members without having to remove the cover. Once the retention members have been backed off, the light assembly may be realigned. The retention members are tightened once the light assembly has been placed in the desired position.

This invention is advantageous because it enables an installer to correctly position a cover of a recessed light regardless of the position its housing. Not only does this process save time, but it also increases the aesthetic qualities of the light fixture.

BRIEF DESCRIPTION OF THE DRAWINGS

The accompanying drawings, which are incorporated in and form a part of the specification, illustrate embodiments of the present invention and, together with the description, disdose the principles of the invention, wherein.

DETAILED DESCRIPTION OF THE PREFERRED EMBODIMENT

Figure 1:
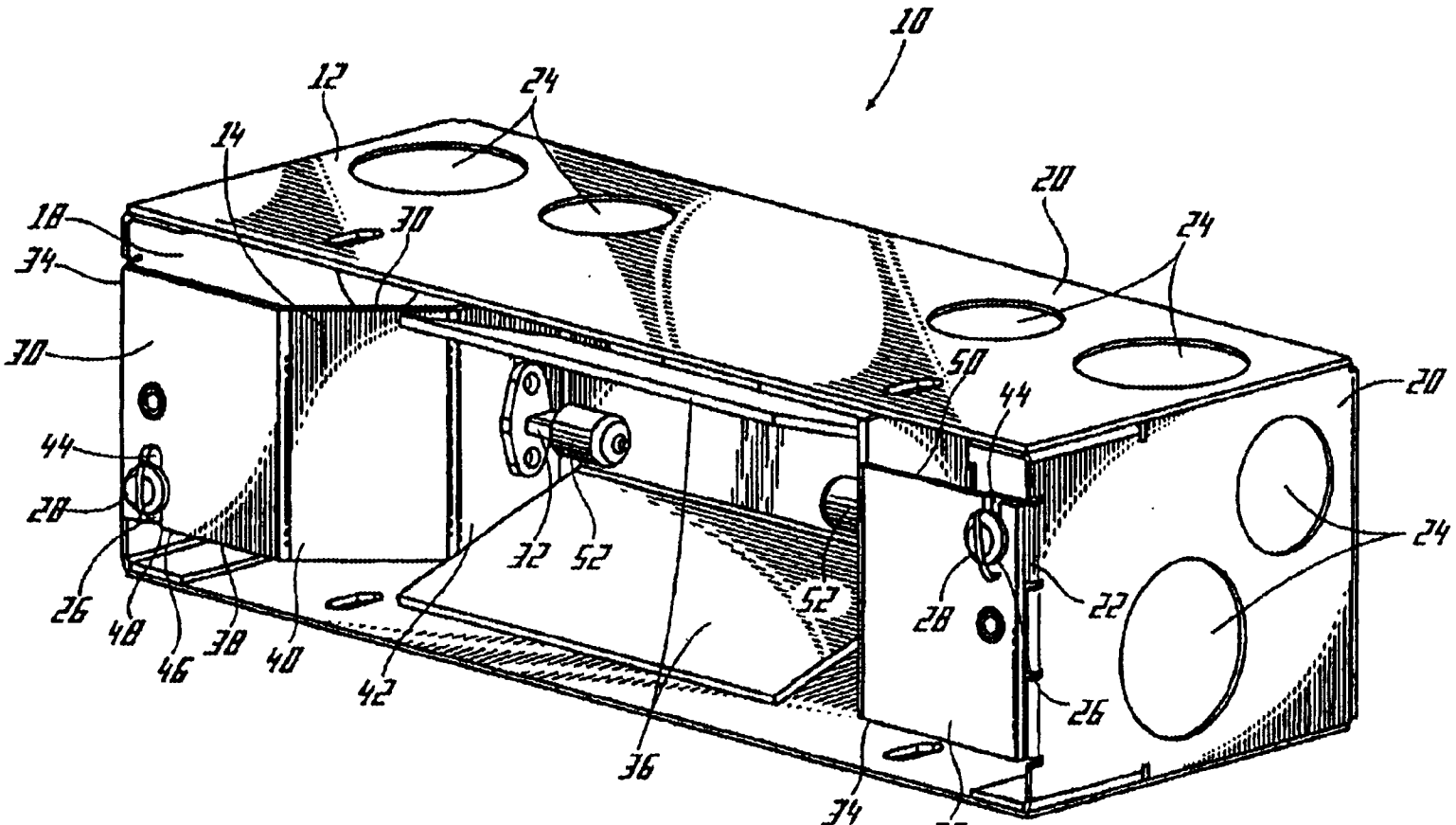
FIG. 1 is a perspective view of a recessed light fixture including a housing and a light assembly.

Referring now to the drawings wherein like numerals represent the same or equivalent structure and, in particular, to FIG. 1 of the drawings, there is illustrated a light fixture 10 according to the present invention having an adjustable mounting system enabling the light fixture to be adjusted. More particularly, the mounting system is capable of being rotated so that the light assembly is level in relation to a ground surface or other desired point of reference.

The light fixture 10 includes a housing 12, a light assembly 14 and a cover 16. Generally, the housing 12 is a hollow box-like structure having an opening 18 on at least one side 20 and at least one flange 22. In one embodiment, the housing 12 has six sides 20. Alternatively, the housing 12 can be any shape sized to receive a light assembly 12. For instance, the housing 12 may be hemispherical, elliptical, or polygonal. Further, the housing 12 includes at least one knockout port 24 for receiving electrical wiring. Each side of the housing 12 may include a knockout port 24. Alternatively, the housing 12 may not include a knockout port 20 or the housing 12 may have any combination of sides including knockout ports 24. Further, the knockout port 24 may include shapes such as, but not limited to, circles or polygons composed of for instance, squares or rectangles. The housing also includes at least one aperture 25 for receiving a screw for attaching and securing the housing 12 to a support structure. Further, the housing 12 may be a junction box. The housing 12 is typically made of any material that is compliant with Underwriter's Laboratory VO fire-rating, such as a fire retardant plastic or metal.

The opening 18 located in the housing 12 is sized to receive the light assembly 14. Preferably, the housing 12 includes two flanges 22, one mounted on each side of the opening 18, as shown in FIG. 1. Each flange 22 includes a hole 26 for receiving a retention member 28. The retention member 28 may include, but is not limited to a screw, a bolt, or a push pin having deformable retention rings. In the embodiment wherein the retention member 28 is a screw, the hole 26 is threaded. However, in an alternative embodiment, the hole 26 need not be threaded. In this embodiment, a nut and bolt can be used. The nut may either be attached to the flange 22 or not. In the embodiment having the nut attached to the flange 22, the nut may be welded to the flange 22 or formed within the flange 22 during manufacture of the flange 22 and housing 12. If the nut is not attached to the flange 22, a lock washer, lock ring, or other retention device may be used together with the bolt.

The light assembly 14 includes a frame 30 and at least one light bulb receptacle 32. Preferably, the frame 30 comprises two support members 34 and at least one reflective surface 36. The support members 34 further comprise a mounting plate 38, a transition plate 40, and a receptacle receiving plate 42. At least one mounting plate 38 contains a slot 44. The slot 44 is sized to receive the retention member 28. Specifically, the slot 44 should be sized so that it is wide enough to receive a shaft of a retention member 28 yet narrower than a head 29 of a retention member 28. Each mounting plate 38 is coupled to a transition plate 38. The transition plates 38 are positioned generally at acute angles relative to a plane that includes the mounting plates 38. The transition plates 38 are mounted to the two generally opposed receptacle receiving plates 42.

In one embodiment, the frame 30 is composed of two mounting plates 38 which are positioned at opposite ends of the frame 30. A slot 44 is located within each mounting plate 38 that extends from an outer edge 46 of each mounting plate 38 into the body of the mounting plate 38. As shown in FIG. 1, one slot 44 can extend from a bottom edge 48 of the mounting plate 38, and a second slot 44 can extend from a top edge 50 of the mounting plate 38 positioned within the opposite end of the frame 30. In an alternative embodiment, both slots 44 set forth above can be positioned at opposite ends of the frame 30 within bottom edges 48 or both slots 44 can be located within top edges 50. In another alternative embodiment, the frame 30 may include only a single slot 44. In this embodiment, the slot 44 may be positioned either on a bottom edge 48 or a top edge 50. Further, the opposite end is connected to the flange 22 using a retention member 28 positioned within a hole in the flange 22. Thus, the light assembly 14 pivots around the retention member 28 positioned within the hole in the flange 22.

The at least one reflective surface 36 connects and receives support from the support members 34. The at least one reflective surface 36 is positioned proximate the at least one light bulb receptacle 32 in order to direct the light as desired. In one embodiment, the at least one reflective surface 36 is attached between two receptacle receiving plates 42 and angled so that light produced by at least one light bulb 52 is directed out of the opening 18 of the housing 12. The at least one reflective surface 36 can have a mirrored finish. Alternatively, the at least one reflective surface 36 can be less reflective than a mirror. Specifically, the at least one reflective surface 36 can absorb a portion of the light produced within the light fixture and reflect a portion of the light striking it. Such an embodiment may be desired in certain situations where dim lighting is desired. The at least one reflective surface 36 can be attached to the receptacle receiving plate 42 through means such as, but not limited to, snap fittings, adhesives, grooves, dovetails, or thermal bonding.

The frame 30 includes at least one receptacle receiving plate 42 to which at least one light bulb receptacle 32 is attached. Each light bulb receptacle 32 is preferably sized to receive standard sized light bulbs 52 which are commonly known in the art. Alternatively, each light bulb receptacle 32 may be a custom design. Further, each light bulb receptacle 32 can include a means for attaching a light bulb 52 to the receptacle 32. Means for attaching a light bulb 52 may include threads, a spring loaded quick connect connection that is commonly used in the art, an interference fit, a pin connection used in fluorescent lighting applications, or any other connection commonly used in the art. The light bulbs 52 shown in FIG. 1 are positioned generally parallel to the longitudinal axis of the frame 30. In an alternative embodiment, the light bulbs 52 can be positioned generally perpendicular to the longitudinal axis or at any angle between these two positions. In the preferred embodiment, light bulbs 52 are high output halogen lamps. However, depending on the desired effect, the light bulbs 52 can be selected to produce light such as, but not limited to white light, soft light, colored light, ultraviolet light, or what is commonly referred to as black light. In addition, lenses, diffusers or filters can be placed in front of the light bulbs 52 to reduce glare or spread the beam emitted from the bulbs.

The light bulbs 52 and the opening 18 are covered once the light fixture 10 is completely assembled and the faceplate or cover 16 has been attached. The cover 16 may be formed from a variety of materials in numerous different designs. For instance, the cover 16 can be formed partially of an opaque material that is aligned with each mounting plate 38 and partially of a transparent or translucent material that is aligned with the light bulbs 52. The transparent or translucent material may include, but is not limited to glass, plastic, and PLEXIGLASS (a thermoplastic poly(methyl methacrylate)-type polymer). In another embodiment, the cover 16 can be composed of a single material. The cover 16 may be smooth in appearance or have a texture.

Figure 4:
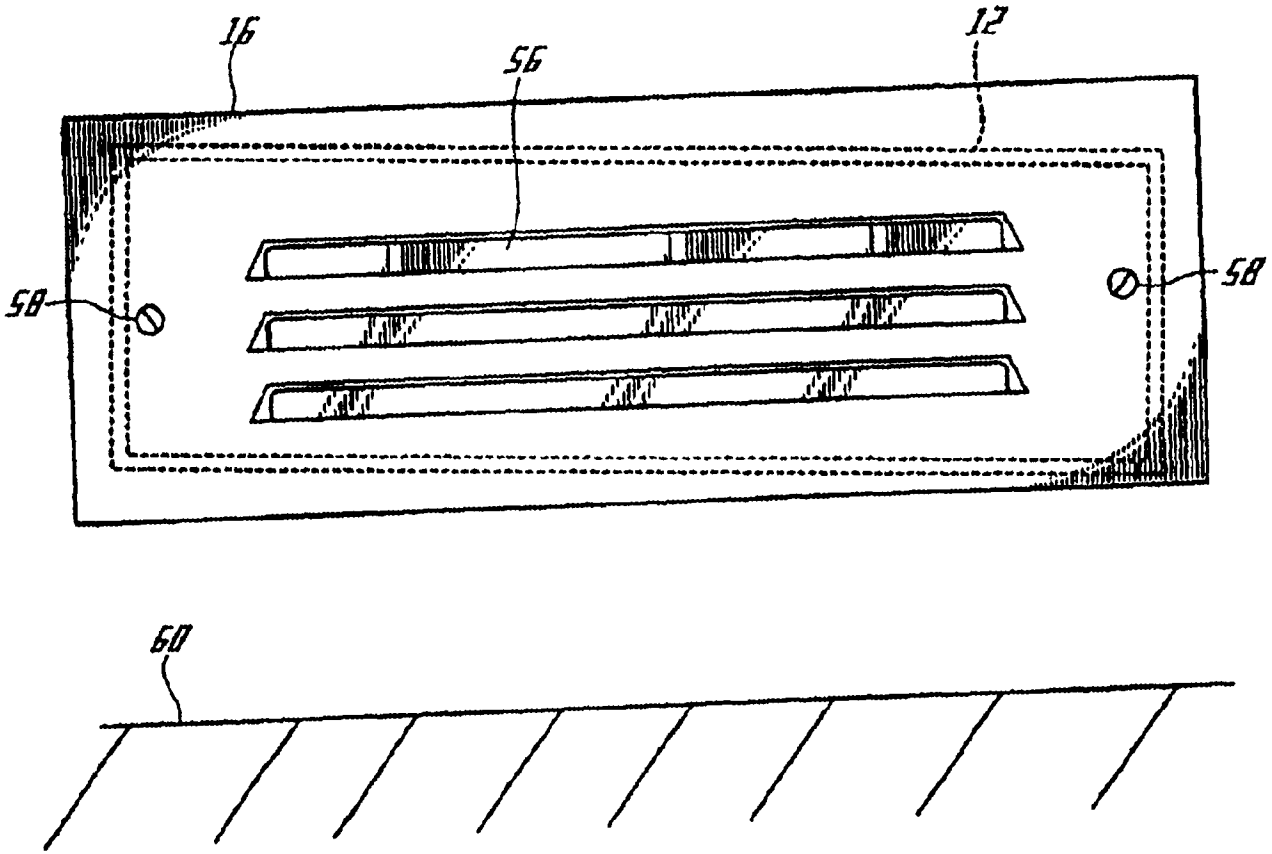
FIG. 4 is a front plan view of an assembled recessed light fixture with a louvered front plate.

In yet another embodiment, the faceplate or cover 16 may be formed from an opaque material such as, but not limited to, copper; brass stainless steel; chrome plated steel; anodized or powder-coated aluminum, polymers; or wood; such as teak, oak, cherry, walnut, or mahogany. In this embodiment, the cover 16 includes at least one narrow, long opening, i.e., a louver, positioned parallel to the longitudinal axis of the cover 16. Generally, the louver is intended to be parallel with the ground or other nearby reference line. Preferably, the cover 16 includes between 3 and 7 openings or louvers 56 that are directed downward so that the light produced by the light fixture 10 is directed downward, as illustrated in FIG. 4.

Figure 2:
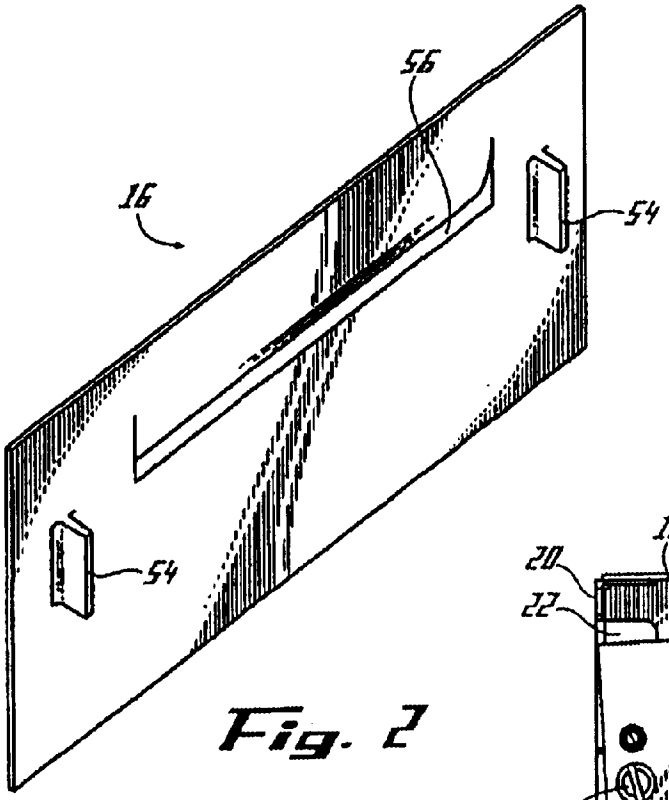
FIG. 2 is a perspective view of a cover including retention snaps for positioning a cover on a light assembly.

The cover 16 further includes a means for being attached to the light assembly 14. In one embodiment, the cover 16 can be attached to the light assembly through at least one hole positioned within the cover. Preferably the hole is located within a flange extending within the louver opening, thereby concealing the screw, or other attachment device, from view once the cover has been installed. Alternatively, the hole can be countersunk and can be positioned on the cover 16 outside of an opening, with attachment being achieved by screws 58, such as are shown in FIG. 4. As another alternative, the means for attaching the cover 16 can include rectangular retention snaps 54, as shown in FIG. 2. The retention snaps 54 are received by openings within the mounting plates 38, thereby attaching the cover 16 to the light assembly 14. Further, the means may include other methods of attachment commonly known in the art.

A slight variation of the opaque cover 16 set forth immediately above includes separating the louvers or sizing portions of a louver opening to provide access to the retention members 28 when the cover 16 is installed on the frame 30. Specifically, the access holes are aligned with the retention members 28. This allows an installer to attach the cover 16 to the frame 30 and adjust the position of the cover 16 without first having to remove the cover 16.

The light fixture 10 set forth above may be installed in numerous locations such as, but not limited to, a wall or any other nearly vertical structure composed of different materials such as concrete block, stucco, brick, brick tile, poured concrete, drywall, wood, flag, slate, tile, paneling, metal, or any combination thereof. The light fixture 10 can be installed into a block wall by first creating a recess or hole in the concrete block large enough to receive the housing 12. However, the opening should not be larger than the exterior dimensions of the cover 16 so that cover 16 conceals the opening after the cover has been Installed. Before the housing 12 is mounted to the wall, the electrical wires that provide electricity to the light fixture 10 are inserted through at least one knockout port 24 in the housing 12. The housing 12 is then inserted into the hole in the wall and attached to the concrete block using attachment means such as, but not limited to, mortar, caulk, adhesives, or screws. If the light assembly 14 is attached to the housing 12, it should be removed from the housing 12 in order to connect the electrical wires to the at least one light bulb receptacle 32. After the light assembly 14 is removed from the housing, the electrical wires are connected to each light bulb receptacle 32.

Figure 3:
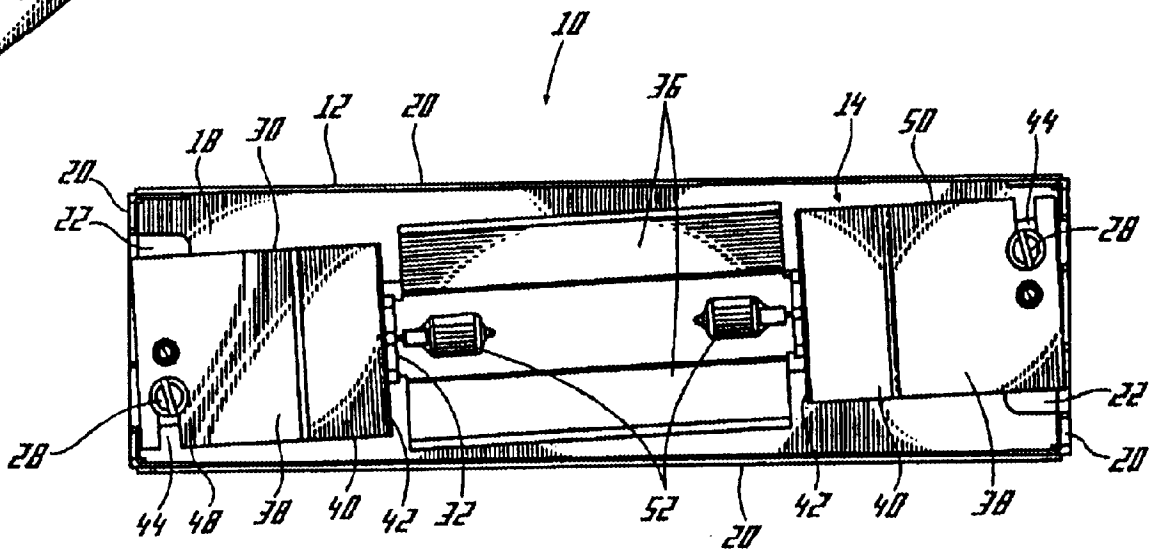
FIG. 3 is a front plan view of a recessed light fixture wherein a light assembly is coupled to a housing and is rotated around the retention members located within the slots.

Once the electrical wires have been attached, the light assembly 14 is positioned within and attached to the housing 12. If the at least one retention member 28 is already coupled to the flanges 22 of the housing 12, the light assembly 14 is inserted into the housing 12 and rotated in order to correctly align the at least one slot 44 with the at least one retention member 28, as shown in FIG. 3. If the housing 12 is severely out of position, the housing 12 can be removed and repositioned. Alternatively, the light assembly 14 could be inserted into a housing 12 not yet having at least one retention member 28 installed. In this embodiment, the at least one retention member 28 could be installed within the flanges 22 after the light assembly 14 is installed in the housing 12. After the light assembly 14 has been installed, the at least one retention member 28 is tightened.

After the light assembly 14 has been attached to the housing 12, the light assembly is positioned so that it is level with the ground or other desired reference point. The installer may insure that the light assembly 14 is level by using a bubble level or without the aid of instrumentation. The cover 16 is attached to the light assembly 14. Once the cover 16 has been installed, the light assembly's position is checked. If the installer is not satisfied with the cover's position, the installer can remove the cover 16 and realign the light assembly 14 by backing out the at least one retention member 28 and adjusting the light assembly 14. The at least one retention member 28 is tightened and the cover is reinstalled. The Installer once again checks the position of the light assembly 14. If the installer is satisfied with the light assembly's position, the installation process is complete. Otherwise, the process is repeated. FIG. 4 illustrates an example of a fixture for which the housing 12 (indicated by dashed lines) is misaligned by an angle of about 10 degrees relative to ground level line 60. The light assembly (not shown) and cover 16 have thus been rotated, in this case counterclockwise, to make the longitudinal lines of the cover 16 parallel to the ground level line 60.

If an alternative cover 16 having holes under the vents granting access to the retention members 28 is used, removal of the cover 16 to adjust the cover's position is not necessary. Instead, the light assembly 14 can be adjusted with the cover 16 affixed on the light assembly 14 by inserting a screw driver, for instance, through the cover 14 to engage and rotate the at least one retention member 28. Alternatively, another tool can be inserted into the cover 16 to release the at least one retention member 28, if the at least one retention member 28 is composed of something other than a screw. After the at least one retention member 28 has been loosened, the cover 18 can be positioned as desired and the at least one retention member 28 can be tightened once again in position.

While various embodiments of this invention have been described above, these descriptions are given for purposes of illustration and explanation. Variations, changes, modifications and departures from the systems and methods disclosed above may be adopted without departure from the spirit and scope of this invention.

I claim:

1. An electrical light fixture for recessed installation in a structure, the structure having a reference level, the fixture comprising:

a housing for receiving a light assembly comprising:
an opening; and
at least one flange;

at least one retention member coupled to the at least one flange;

the light assembly disposed within the housing comprising:
a frame;
at least one light bulb receptacle attached to the frame; and
at least one slot positioned within the frame for receiving the at least one retention member, the at least one slot having a length adapted to permit rotation of the light assembly relative to the housing; and a cover attached to the light assembly for transmitting light away from the light assembly, the cover having a longitudinal axis;

wherein, if the cover is oriented at an angle relative to the reference level, the light assembly is rotated relative to the housing to align the cover with the reference level.

2. The electrical light fixture of claim 1, wherein the cover further includes at least one opening for transmitting light produced within the electrical light fixture.

3. The electrical light fixture of claim 2, wherein the at least one opening is at least one louver positioned parallel to the longitudinal axis of the cover.

4. The electrical light fixture of claim 3, further including at least one aperture for accessing the at least one retention member when the cover is attached to the electrical light fixture, wherein the at least one aperture is partially hidden from view by the louver.

5. The electrical light fixture of claim 1, further including at least one aperture for accessing the at least one retention member when the cover is coupled to the electrical light fixture.

6. The electrical light fixture of claim 1, wherein the at least one flange is positioned within the opening.

7. The electrical light fixture of claim 1, wherein the at least one slot is positioned generally orthogonal to a bottom floor of the housing.

8. The electrical light fixture of claim 1, wherein the at least one retention member comprises two screws and the at least one flange comprises two flanges.

9. The electrical light fixture of claim 1, wherein the frame further comprises:

a support member, comprising:
two mounting plates wherein at least one of the two mounting plates includes the at least one slot for receiving the retention member and the two mounting plates are positioned in a single plane;
two transition plates coupled to the two mounting plates and positioned generally at acute angles relative to a plane that includes the two mounting plates; and
two generally opposed receptacle receiving plates coupled to the two transition plates for receiving at least one light bulb; and at least one reflective element coupled to and positioned generally orthogonal to the two receptacle receiving plates.

10. The electrical light fixture of claim 9, wherein the two mounting plates further comprise at least one hole for receiving a retention member.

11. The electrical light fixture of claim 1, further comprising at least one aperture for mounting the housing to a wall.

12. The electrical light fixture of claim 1, further comprising at least one knock-out port positioned within the housing for receiving electrical wiring.

13. The electrical light fixture of claim 1, wherein the housing is selected from a group consisting of a fire retardant plastic and a metal.

14. The electrical light fixture of claim 1, wherein the housing is a junction box.

15. A light system comprising at least one electrical light fixture, wherein the at least one electrical light fixture comprises:

a housing for receiving a light assembly comprising:
an opening; and
at least one flange;
at least one retention member coupled to the at least one flange; and the light assembly disposed within the housing comprising:
a frame;
at least one light bulb receptacle attached to the frame;
at least one slot positioned within the frame for receiving the at least one retention member, wherein the light assembly is rotatable relative to the housing by moving the at least one slot relative to the at least one retention member; and a cover attached to the light assembly adapted to transmit light outward from the fixture, wherein rotation of the light assembly chances a relative angle between the cover and a reference level so that the cover is oriented to a desired angle relative to the reference level.

16. The light system of claim 15, further including at least one aperture for accessing the at least one retention member when the cover is coupled to the electrical light fixture.

17. The light system of claim 15, wherein the at least one retention member comprises two screws and the at least one flange comprises two flanges.

18. The light system of claim 15, wherein the frame further comprises:

a support member, comprising:

two mounting plates wherein at least one of the two mounting plates includes the at least one slot for receiving the retention member and the two mounting plates are positioned in a single plane;

two transition plates coupled to the two mounting plates and positioned generally at acute angles relative to a plane that includes the two mounting plates; and two generally opposed receptacle receiving plates coupled to the two transition plates for receiving at least one light bulb; and at least one reflective element coupled to and positioned generally orthogonal to the two receptacle receiving plates.

19. The light system of claim 18, wherein the two mounting plates further comprise at least one hole for receiving a retention member.

20. The light system of claim 15, further comprising at least one aperture for mounting the housing to a wall.

21. The light system of claim 15, further comprising at least one knock-out port positioned within the housing for receiving electrical wiring.

22. The light system of claim 15, wherein the housing is formed from a fire retardant plastic.

23. The light system of claim 15, wherein the housing is formed from metal.

24. The light system of claim 15, wherein the cover is formed from metal or wood.

25. The light system of claim 15, wherein the housing is a junction box.

26. A method of installing a recessed light fixture, comprising:

placing a housing within a support structure, the support structure having a reference level, the housing comprising an opening, at least one flange capable of receiving a retention member; and at least one retention member coupled to the at least one flange;

attaching a light assembly within the housing, wherein the light assembly comprises a frame, at least one light bulb receptacle attached to the frame, and at least one slot positioned within the frame for receiving the at least one retention member;

attaching a cover having a longitudinal axis to the light assembly; and if the longitudinal axis of the cover is disposed at an angle relative to the reference level, leveling the cover by sliding the at least one slot relative to the at least one retention member to rotate the light assembly relative to the housing.

27. The method of claim 26, wherein attaching the light assembly to the housing further comprises tightening the at least one retention member against the light assembly.

28. The method of claim 26, wherein leveling the light assembly in the desired position further includes using a level.

29. The method of claim 26, wherein leveling further includes removing the cover, backing out the retention members, repositioning the light assembly, retightening the retention members and reinstalling the cover.

30. The method of claim 26, wherein the cover further includes at least one louver positioned parallel to the longitudinal axis of the cover for releasing light produced within the electrical light fixture, and at least one aperture for accessing the at least one retention member when the cover is coupled to the electrical light fixture, wherein the at least one aperture is partially hidden from view by the vent.

31. The method of claim 30, further including backing out the retention members, repositioning the light assembly, and retightening the retention members.

32. The light system of claim 15, wherein the cover has at least one louver formed therein for transmitting light outward from the fixture.

33. The light system of claim 32, wherein the cover is generally rectangular in shape and the at least one louver is disposed parallel to a longitudinal axis of the cover.

34. The light system of claim 32, wherein the cover has at least one aperture formed therein for accessing the at least one retention member when the cover is attached to the electrical light fixture, wherein the at least one aperture is partially hidden from view by the louver.

* * * * *